US008827412B2

(12) United States Patent
Kanome et al.

(10) Patent No.: US 8,827,412 B2
(45) Date of Patent: Sep. 9, 2014

(54) PRINTING APPARATUS AND PRINTING METHOD

(71) Applicant: Canon Kabushiki Kaisha, Tokyo (JP)

(72) Inventors: Yuji Kanome, Yokohama (JP); Takashi Horiba, Kawasaki (JP); Masahiro Sugimoto, Yokohama (JP); Kanto Kurasawa, Kawasaki (JP); Hikaru Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/654,915

(22) Filed: Oct. 18, 2012

(65) Prior Publication Data

US 2013/0100198 A1 Apr. 25, 2013

(30) Foreign Application Priority Data

Oct. 21, 2011 (JP) ..... 2011-232041

(51) Int. Cl.
*B41J 29/377* (2006.01)
*B41J 2/01* (2006.01)

(52) U.S. Cl.
USPC ..... 347/18; 347/104

(58) Field of Classification Search
USPC ..... 347/1, 4, 18, 101, 102, 103, 104
See application file for complete search history.

(56) References Cited

U.S. PATENT DOCUMENTS

| | | | | |
|---|---|---|---|---|
| 6,299,685 | B1 * | 10/2001 | Siler et al. | 118/58 |
| 6,588,892 | B1 * | 7/2003 | Stramel et al. | 347/102 |
| 6,601,951 | B2 * | 8/2003 | Kuwabara et al. | 347/101 |
| 6,663,238 | B2 * | 12/2003 | Kikuchi et al. | 347/102 |
| 7,628,481 | B2 * | 12/2009 | Kadomatsu et al. | 347/102 |
| 8,360,571 | B2 * | 1/2013 | Kinoshita | 347/102 |
| 8,449,105 | B2 * | 5/2013 | Kanazawa | 347/104 |

FOREIGN PATENT DOCUMENTS

JP 2011-121354 A 6/2011

* cited by examiner

*Primary Examiner* — Anh T. N. Vo
(74) *Attorney, Agent, or Firm* — Canon U.S.A., Inc. IP Division

(57) ABSTRACT

A printing apparatus includes a cooling unit configured to actively cool a sheet, a humidification unit configured to increase a moisture content of the sheet by supplying a humidified gas onto the sheet, and an inkjet print head configured to perform printing on the sheet having a moisture content increased by the humidification unit.

11 Claims, 5 Drawing Sheets

PRINTING APPARATUS AND PRINTING METHOD

BACKGROUND OF THE INVENTION

1. Field of the Invention

Aspects of the present invention relate to a printing apparatus that includes an inkjet print head.

2. Description of the Related Art

In an inkjet printing apparatus, a sheet passing quickly under a print head absorbs moisture in the air. Consequently, the ink discharge nozzles in the print head dry more quickly, which can cause problems with printing, such as ink clogging of the nozzles.

Regarding this issue, Japanese Patent Application Laid-Open No. 2011-121354 discusses a printing apparatus that includes a mechanism for suppressing the sheet from absorbing moisture below the print head by humidifying the sheet before it reaches the print head. In the apparatus discussed in Japanese Patent Application Laid-Open No. 2011-121354, the moisture content of the sheet is increased by supplying a humidified gas onto the sheet from a first supply port. In addition, a humidified gas is supplied from a second supply port, which is located closer to the print head than the first supply port, into a space where the nozzles of the print head are exposed. Based on this mechanism, the humidity of the space where the nozzles are exposed is maintained so that the nozzles retain their moisture.

Some printing apparatuses include a mechanism for heating the sheet before printing, such as a decurling mechanism that corrects curl by applying heat onto the sheet. In such an apparatus, because the sheet is hot, the sheet does not sufficiently absorb moisture even if a humidified gas is supplied onto the sheet before printing, as is discussed in Japanese Patent Application Laid-Open No. 2011-121354. This is because for a sheet having high hygroscopicity such as paper, the higher the temperature of the sheet, the less moisture that the sheet can absorb. In other words, the lower the temperature of the sheet, the greater the amount of moisture that the sheet can absorb.

If a sheet is fed to a printing unit at a high temperature but without sufficient moisture absorption, the hygroscopicity of the sheet increases due to a decrease in the sheet temperature during that time, so that a lot of the humidity is taken from the space where the nozzles are exposed in the print head. Consequently, problems can occur with printing due to the nozzles becoming dry.

SUMMARY OF THE INVENTION

Aspects of the present invention relate to suppressing printing defects caused by drying of a print head even when a sheet is heated before printing.

According to an aspect of the present invention, a printing apparatus includes a cooling unit configured to actively cool a sheet, a humidification unit configured to increase a moisture content of the sheet by supplying a humidified gas onto the sheet, and an inkjet print head configured to perform printing on the sheet having a moisture content increased by the humidification unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An inkjet printing apparatus according to an exemplary embodiment of the present invention is a high-speed line printer that uses a continuous sheet wound in a roll shape and that can handle both one-sided printing and two-sided printing. This type of printing apparatus is suited to fields in which a large quantity of sheets is printed, such as at a print lab. Aspects of the present invention can be applied in a wide range of printing apparatuses, such as a printer, a printer multifunction peripheral, a copying machine, and a facsimile machine, but are not limited to printing apparatuses. For example, aspects of the present invention can be widely applied in various other apparatuses, such as industrial equipment (production apparatuses for various devices, scanning apparatuses etc.) used in factories that require a user to specify an apparatus operating time and require a long time for an initialization operation during start-up.

Figure 1:
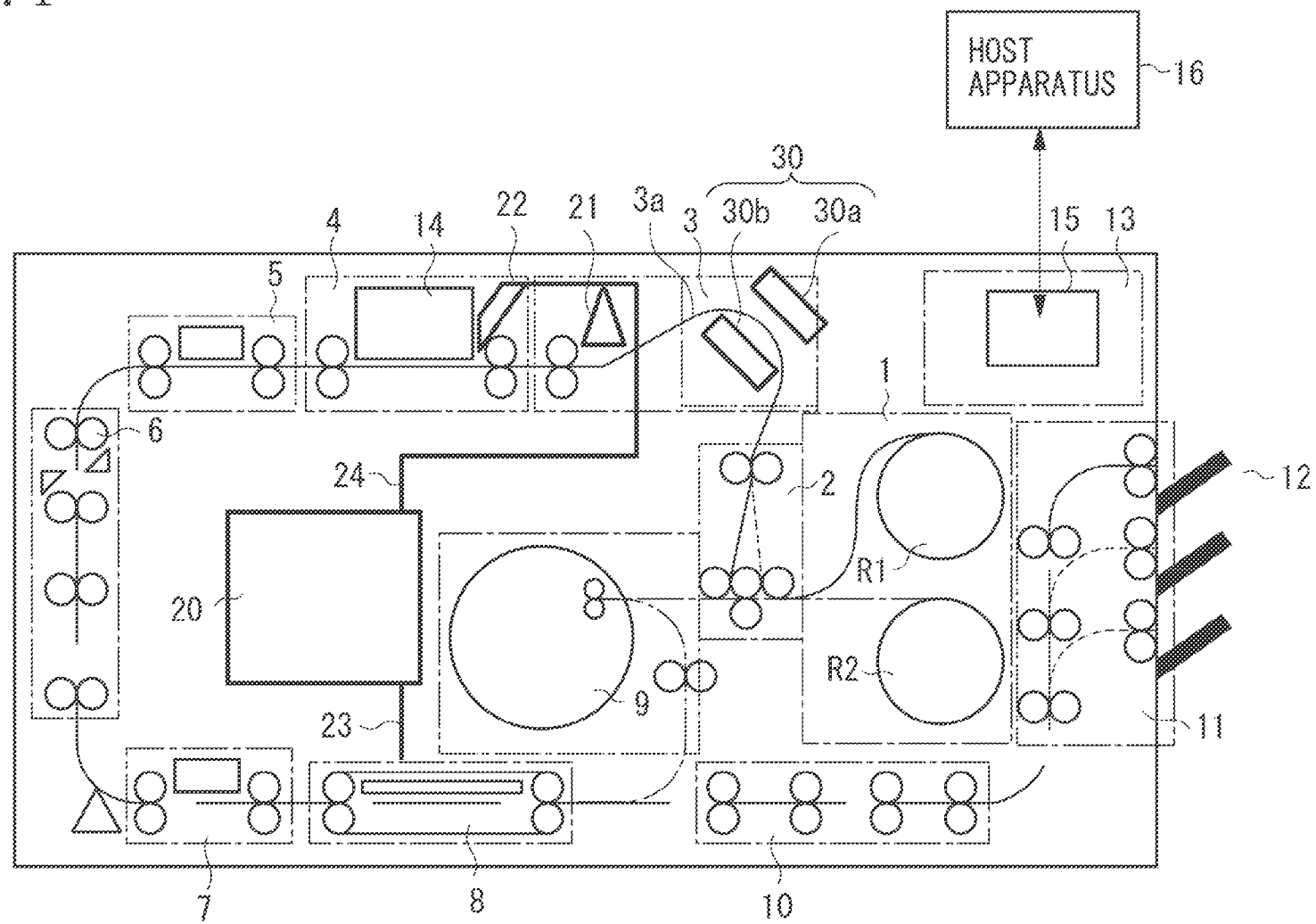
FIG. 1 illustrates an internal configuration of a printing apparatus according to an exemplary embodiment.

FIG. 1 is a cross-sectional view illustrating an internal configuration of a printing apparatus according to an exemplary embodiment. The printing apparatus according to the present exemplary embodiment uses a sheet wound in a roll shape. The printing apparatus can print on both a first surface and a second surface (which is on the back side of the first surface) of the sheet. The printing apparatus includes a sheet feeding unit 1, a decurling unit 2, a skew correction unit 3, a printing unit 4, an inspection unit 5, a cutter unit 6, an information recording unit 7, a drying unit 8, a reversing unit 9, a discharge conveyance unit 10, a sorter unit 11, a discharge unit 12, a humidification unit 20, a cooling unit 30, and a control unit 13. The sheet is processed by the respective units while being conveyed along a sheet conveyance path, indicated by the solid line in FIG. 1, by a conveyance mechanism configured from a pair of rollers and a belt.

The sheet feeding unit 1 stores and feeds a continuous sheet wound in a roll shape. The sheet feeding unit 1 can hold two rolls, a roll R1 and a roll R2, and can alternatively draw out and feed either sheet. The number of rolls that can be stored is not limited to two, and only one roll or more than two rolls may be stored.

The decurling unit 2 reduces the curl (warp) of the sheet fed from the sheet feeding unit 1. The decurling unit 2 reduces curl by using two pinch rollers on respective sides of one drive roller, so that when a sheet is passed through these rollers a decurling force acts on the sheet in the opposite direction of the curl. A heater is included in the drive roller of the decurling unit 2 to increase the curl reduction effect by making the decurling force act when the sheet is in a heated state.

The skew correction unit 3 corrects the skew (tilt with respect to the original progress direction) of a sheet that has passed through the decurling unit 2. The sheet skew is corrected by pressing a sheet edge portion that acts as a reference against a guide member. To correct the sheet skew, a loop-shaped slack section 3*a* that bulges outwards is formed on the conveyed sheet by the skew correction unit 3. The loop-shaped slack section 3*a* absorbs distortions in the sheet produced during skew correction, so that the sheet skew is corrected without damage to the sheet. Further, a cooling unit 30 for actively cooling the conveyed sheet is included in the skew correction unit 3. The cooling unit 30 will be described in more detail below.

The printing unit 4 forms an image on a conveyed sheet by performing print processing on the sheet with a print head 14 from above the conveyed sheet. The printing unit 4 includes a plurality of conveyance rollers that convey the sheet. The print head 14 has a line type print head in which an inkjet nozzle array is formed across a range that covers the maximum width of the sheets that will conceivably be used. The print head 14 is configured from a plurality of print heads aligned in parallel in the conveyance direction. In the present exemplary embodiment, the print head 14 has seven print heads, corresponding to the colors of cyan (C), magenta (M), yellow (Y), light cyan (LC), light magenta (LM), grey (G), and black (K). The number of colors and the number of print heads are not limited to seven. The inkjet method may include a method that employs a heating element, a piezoelectric element, an electrostatic element, and a micro electro mechanical systems (MEMS) device. Each of the color inks is supplied to the print head 14 via a respective ink tube from an ink tank.

In the printing unit 4, a highly humidified gas is supplied into a space where the nozzles of the print head 14 are exposed to suppress drying of the nozzles. This process will be described in more detail below.

The inspection unit 5 determines whether an image was correctly printed by optically reading an inspection pattern or the image printed on the sheet by the printing unit 4 with a scanner, and inspecting the state of the nozzles in the print head, the sheet conveyance state, and the image position. The scanner has a charge-coupled device (CCD) image sensor or a complementary metal-oxide semiconductor (CMOS) image sensor.

The cutter unit 6 includes a mechanical cutter that cuts a printed sheet to a predetermined length. The cutter 6 also includes a plurality of conveyance rollers for feeding the sheet to the next step.

The information recording unit 7 records print information (unique information), such as a print serial number or the date, on a non-printing region of the cut sheet. The recording is performed by printing characters or codes by an inkjet or heat transfer method.

The drying unit 8 heats the sheet printed by the printing unit 4 to dry the coated ink in a short period of time. In the interior of the drying unit 8, the ink-coated surface is dried by hot air blown on the conveyed sheet from at least the bottom surface side. The drying method is not limited to a blowing hot air. Drying may also be performed by irradiating electromagnetic waves (e.g., UV-rays and infrared rays) on the sheet surface.

The reversing unit 9 is a sheet take-up unit that, during two-sided printing, reverses the front and back surfaces of the sheet by temporarily taking up the continuous sheet after printing of the front surface. The reversing unit 9 is provided midway along a path (loop path) that goes from the drying unit 8 to the printing unit 4 via the decurling unit 2 in order to re-feed a sheet that has passed through the drying unit 8 to the printing unit 4. The reversing unit 9 includes a take-up rotating body (drum) that rotates in order to take up the sheet. A continuous sheet that has finished printing on the front surface but has not yet been cut is temporarily taken up onto the take-up rotating body. Once take-up has finished, the take-up rotating body is rotated in the reverse direction, so that the taken-up sheet is conveyed in the reverse order to that when it was taken up. The sheet is fed into the decurling unit 2, and conveyed to the printing unit 4. Since the front and back surfaces of this sheet have been reversed, the back surface can be printed on by the printing unit 4.

The discharge conveyance unit 10 conveys a sheet that has been cut by the cutter 6 and dried by the drying unit 8, and transfers the sheet to the sorter unit 11. The sorter unit 11 sorts sheets that have been printed into groups as necessary, and discharges the sorted sheets to the discharge unit 12, which is configured from a plurality of trays.

The humidification unit 20 generates a humidified gas (air) and supplies the generated humidified gas onto the sheet before it is printed. Further, the humidification unit 20 also generates an air flow by supplying the humidified gas into a space between the print head 14 in the printing unit 4 and the sheet. Drying of the ink in the print head 14 nozzles is suppressed by the humidification generated by the humidification unit 20.

The humidification method of the humidification unit 20 employs a method such as a gasification method, a water atomization method, and a steam method. A gasification method includes, in addition to the rotation method according to the present exemplary embodiment, a method employing a permeation membrane system, a trickle filtration system, and a capillary tube system. A water atomization method includes a method employing an ultrasonic system, a centrifugal system, a high-pressure spray system, and a twin-fluid atomization system. A vaporization method includes a method employing a steam piping system, an electrothermal system, and an electrode system.

The humidification unit 20 generates a humidified gas onto the sheet. A first supply port 21 for supplying the humidified gas onto the sheet before printing to increase the moisture content of the sheet and a second supply port 22 for supplying humidified gas into a space between the print head 14 and the sheet are provided before the print head 14. The humidification unit 20, the first supply port 21, and the second supply port 22 are connected by a duct 24. Further, the humidification unit 20 and the drying unit 8 are connected by a duct 23.

A humid and hot gas is generated by the drying unit 8 when drying the sheet. Part of the gas (heat) is introduced into the humidification unit 20 via the duct 23 to be used by the humidification unit 20 as supplemental energy for generating the humidified gas. A part of the humidified gas generated by the humidification unit 20 is supplied before the print head 14 toward the sheet surface via the first supply port 21. Further, a part of the humidified gas generated by the humidification unit 20 is supplied from the upstream side into a space directly beneath the print head 14 via the second supply port 22, so that a humidified gas flow is formed flowing in a direction from upstream to downstream.

The control unit 13 controls each unit in the printing apparatus. The control unit 13 includes a central processing unit (CPU), a storage device, a controller (control unit) including various control units, an external interface, and an operation unit 15 on which the user performs inputs and outputs. Operation of the printing apparatus is controlled based on commands from the controller or a host apparatus 16, such as a host computer, connected to the controller via the external interface.

Figure 2:
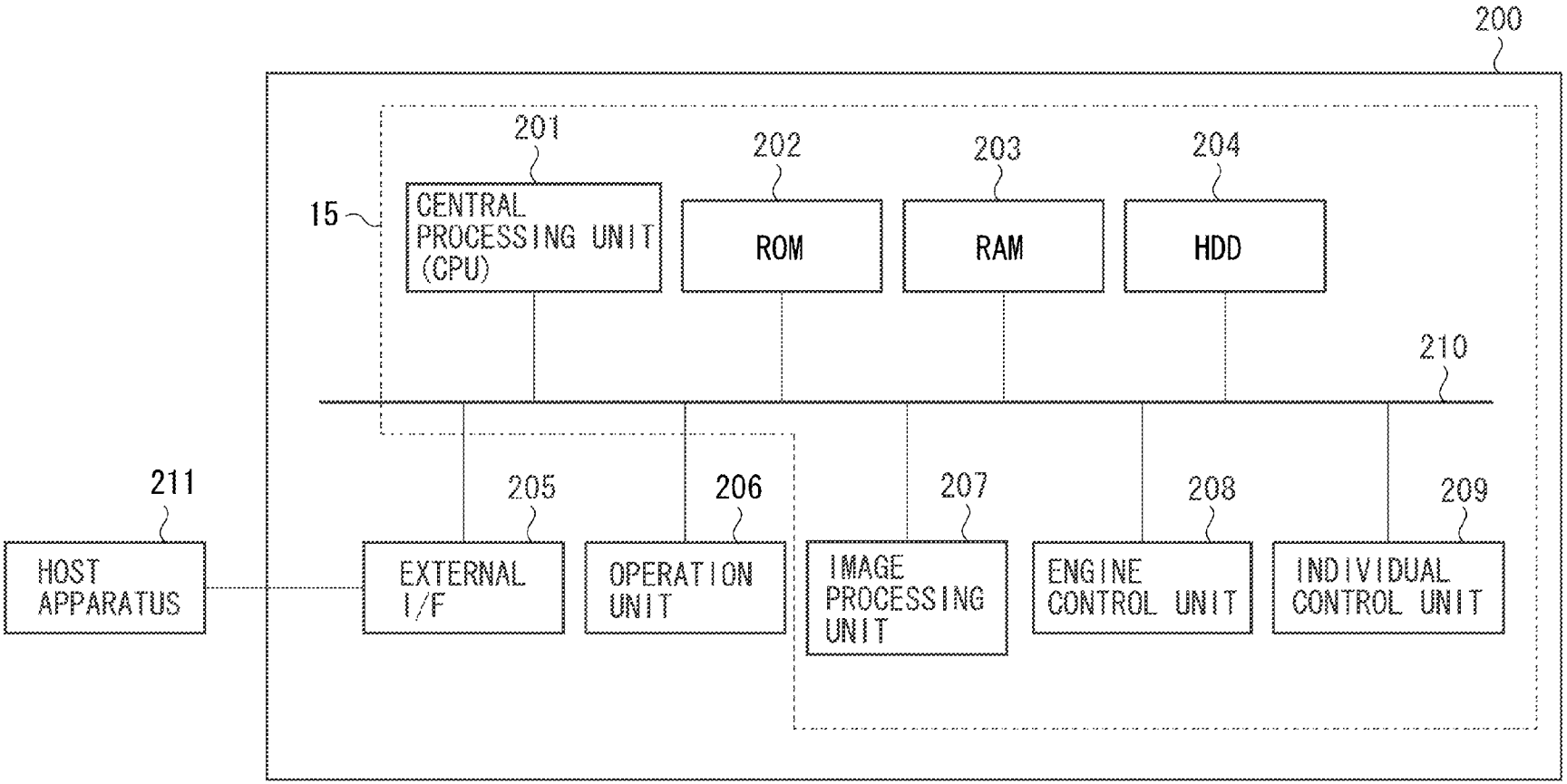
FIG. 2 is a block diagram illustrating a control unit.

FIG. 2 is a block diagram illustrating an outline of the control unit 13. The controller included in the control unit 13 (area enclosed by the dashed line) includes a CPU 201, a read-only memory (ROM) 202, a random access memory (RAM) 203, a hard disk drive (HDD) 204, an image processing unit 207, an engine control unit 208, and an individual control unit 209. The CPU 201 controls the operation of the respective units in the printing apparatus in an integrated manner. The ROM 202 stores programs to be executed by the CPU 201 and the fixed data required for the various operations of the printing apparatus. The RAM 203 is used as a work area for the CPU 201 and as a temporary storage area for various kinds of received data. The RAM 203 also stores various setting data. The HDD 204 can store and read programs to be executed by the CPU 201, print data, and the setting information required for the various operations performed by the printing apparatus. The operation unit 15 is an input/output interface with the user. The operation unit 15 includes a hard key or a touch panel input unit and an output unit, such as a display, for presenting information or an audio generator.

A dedicated processing unit is provided for units for which high-speed data processing is required. The image processing unit 207 performs image processing on the print data handled by the printing apparatus. A color space (e.g., YCbCr) of the input image data is converted into a standard RGB color space (e.g., sRGB). Further, the image data is subjected, as necessary, to various image processing, such as resolution conversion, image analysis, and image correction. The print data obtained from these image processes is stored in the RAM 203 or the HDD 204. The engine control unit 208 performs, for example, drive control on the print head 14 in the printing unit 4 according to the print data based on a control command received from the CPU 201, for example. The engine control unit 208 also controls the conveyance mechanism of the respective units in the printing apparatus. The individual control unit 209 is a sub-controller for individually controlling the sheet feeding unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, the discharge unit 12, the humidification unit 20, and the cooling unit 30. Operation of the respective units is controlled by the individual control unit 209 based on a command from the CPU 201. An external interface (I/F) 205 connects the controller to the host apparatus 16. The external I/F 205 may be a local I/F or a network I/F. The above-described elements are connected by a system bus 210.

The basic operations performed during printing will now be described. Since the operations for a one-sided printing mode and a two-sided printing mode are different, each of these modes will be described.

In one-sided printing, printing is performed by the printing unit 4 on the front surface of a sheet fed from the sheet feeding unit 1 and processed by both the decurling unit 2 and the skew correction unit 3. The printed sheet passes through the inspection unit 5, and is cut into pre-set predetermined unit lengths by the cutter unit 6. Print information is recorded as necessary on the back surface of the cut sheets by the information recording unit 7. The cut sheets are conveyed one by one to the drying unit 8 to be dried. Then, the sheets pass through the discharge conveyance unit 10 and the sorter 11, and are sequentially discharged and stacked on the discharge unit 12.

In two-sided printing, a back surface printing sequence is executed after the front surface printing sequence. In the initial front surface printing sequence, the operations from the sheet feeding unit 1 to the inspection unit 5 are the same as those for the above-described one-sided printing. The continuous sheet is conveyed as is to the drying unit 8 without performing a cutting operation at the cutter unit 6. After the ink on the front surface is dried by the drying unit 8, the sheet is introduced onto the path on the reversing unit 9 side, not the path on the discharge conveyance unit 10 side. The introduced sheet is taken up by the take-up drum in the reversing unit 9, which is rotating in a forward direction (counterclockwise direction in FIG. 1). At the printing unit 4, when the planned front surface printing is all finished, the trailing edge of the print region of the continuous sheet is cut by the cutter unit 6. Based on the cut position, the continuous sheet on the conveyance direction downstream side (printed side) passes through the drying unit 8, and the entire continuous sheet up to its trailing edge (cut position) is taken up by the reversing unit 9. The continuous sheet further upstream in the conveyance direction than the cut position is fed back to the sheet feeding unit 1 so that the sheet leading edge (cut position) does not remain in the decurling unit 2.

After the above-described front surface printing sequence, the processing switches to the back surface printing sequence. The take-up drum in the reversing unit 9 rotates in the reverse direction (clockwise direction in FIG. 1) to that during take-up. The edge of the taken-up sheet (the sheet trailing edge during take-up becomes the sheet leading edge during feeding) is fed to the decurling unit 2, where curl correction in the opposite direction to that before is performed by the decurling unit 2. This is because the sheet wound on the take-up drum is wound with its front and back surfaces reversed from the roll at the sheet feeding unit 1, so that the sheet is curled in the opposite direction. Then, the sheet passes through the skew correction unit 3, and printing is performed on the back surface by the printing unit 4. The printed sheet passes through the inspection unit 5, and is cut by the cutter unit 6 into pre-set predetermined unit lengths by the cutter unit 6. Since the cut sheets have been printed on both sides, recording is not performed by the information recording unit 7. The cut sheets are conveyed one by one to the drying unit 8, pass through the discharge conveyance unit 10 and the sorter unit 11, and are sequentially discharged and stacked by the discharge unit 12.

Figure 3:
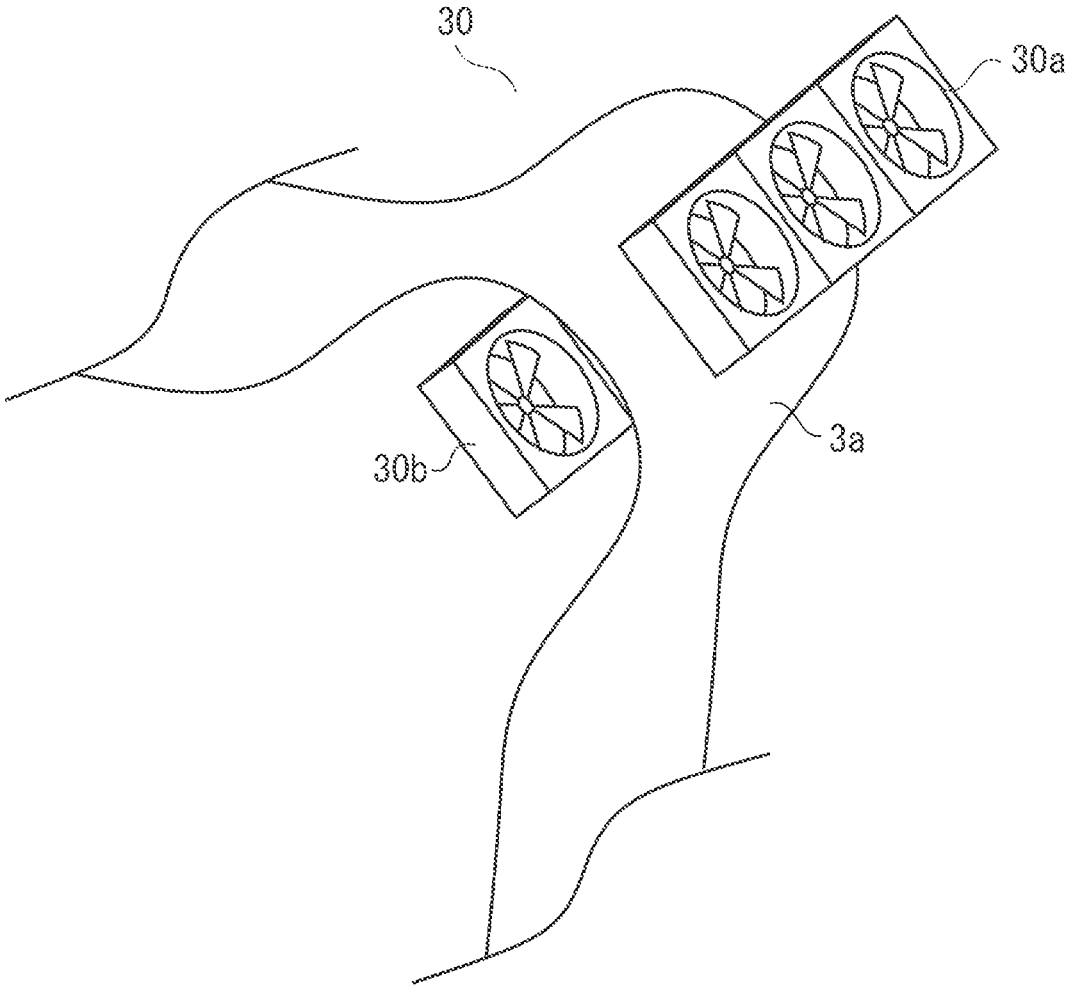
FIG. 3 is a perspective view illustrating a configuration of a cooling unit.

A characteristic feature of the printing apparatus according to the present exemplary embodiment is the cooling unit, which actively cools the sheet before humidification. FIG. 3 is a perspective view illustrating a configuration of the cooling unit 30 in detail.

The cooling unit 30 has cooling fans 30*a* and 30*b*, and is provided inside the skew correction unit 3. Based on the loop-shaped slack section 3*a* of the sheet formed in the skew correction unit 3, the cooling fan 30*a* is arranged on the sheet front surface (printing surface) side and the cooling fan 30*b* is arranged on the sheet back surface side. The cooling fans 30*a* and 30*b* actively cool the conveyed sheet by blowing ordinary temperature air onto both sides of the sheet.

Before being introduced into the cooling unit 30, the sheet is heated to a high temperature by the decurling unit 2. Further, in two-sided printing, a sheet that has undergone printing on a first surface and then passed through the drying unit 8 and heated, is taken up by the reversing unit 9 while still retaining its heat. Then, during printing on the second surface, the still hot sheet is further heated by the decurling unit 2, and conveyed toward the cooling unit 30. The cooling unit 30 actively cools the sheet heated in this manner with a heating unit before humidification by the humidification unit 20.

In the skew correction unit 3, a physical sheet guide is not present on either the front or back face of the sheet so that the loop-shaped slack section 3*a* can be formed in a free size. Consequently, air can be blown from the cooling fans 30*a* and 30*b* over a wide surface area of the sheet surfaces, which enables the sheet to be efficiently cooled with a compact cooling unit. The inner side cooling fan 30*b* may have a greater blowing strength than the outer side cooling fan 30*a*. Accordingly, the shape of the loop-shaped slack section 3*a* can be stably maintained in a state bulging outwards from the blowing of air from the front and back.

The cooling unit 30 is not limited to a configuration of cooling from both the front and back surfaces of the sheet. In one embodiment, the cooling unit 30 may be configured with just the inner side cooling fan 30*b*. Specifically, the cooling unit 30 may be configured so that it actively cools the loop-shaped slack section by blowing air from the direction that makes the loop bulge out. Further, the cooling unit 30 is not limited to blowing air, and may be configured so that it actively cools the sheet by filling a space that the sheet passes through with a low-temperature gas, or actively cools by bring a cooling member into contact with the sheet.

Figure 4:
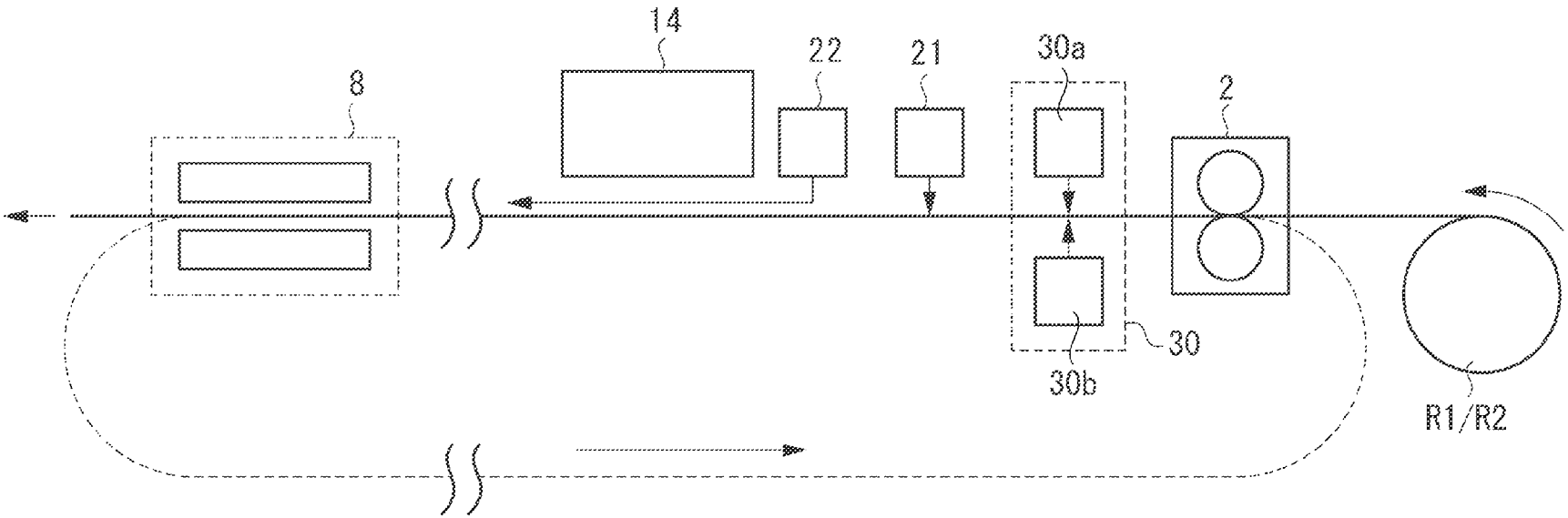
FIG. 4 is a schematic diagram illustrating an arrangement order of the main units along a sheet conveyance path.

FIG. 4 is a diagram schematically illustrating an outline of the arrangement order of the main units along the sheet conveyance path. In FIG. 4, reference numerals that are the same as in FIG. 1 denote the same parts.

A sheet fed from the roll R1 or R2 is subjected to a decurling process while being heated by the decurling unit 2. The heated sheet is actively cooled by air blown by the cooling fans 30*a* and 30*b* in the cooling unit 30. Before the first supply port 21, the sheet is cooled to a temperature less than or equal to the temperature in a nozzle exposed space where the print head 14 is exposed by the printing unit 4. The cooled sheet absorbs moisture while passing from the first supply port 21 through a region where the humidified gas is supplied to increase the moisture content of the sheet. A humidified gas is introduced from the upstream side from the second supply port 22 into the nozzle exposed space where the nozzles in the print head 14 are exposed to suppress drying of the nozzles due to the humidified gas flowing in a direction from upstream to downstream. The moisture content of the sheet is increased by the humidification at the first supply port 21, and reaches a level that is greater than the maximum moisture content of the sheet at the temperature in the nozzle exposed space. Consequently, while the sheet is still passing through the nozzle exposed space, the amount of moisture in that space absorbed by the sheet is reduced. The decrease in humidity in the nozzle exposed space is small. Accordingly, ink drying of the nozzles in the print head 14 in the nozzle exposed space can be effectively suppressed. The sheet that has finished printing passes through the drying unit 8 to be discharged.

In two-sided printing, after printing is finished on a first surface of the sheet based on the above-described procedure, the sheet is passed through the drying unit 8 to be heated. Then, to print on the second surface, the sheet is conveyed toward the decurling unit 2 and the cooling unit 30 (path indicated by the dotted line in FIG. 4). The sheet is again passed through the decurling unit 2 to further increase its temperature, and then actively cooled by the cooling unit 30. The procedure of the subsequent processes is the same as that described above. In two-sided printing, although the sheet is heated before the printing of both the first surface and the second surfaces, printing defects due to drying of the print head can be suppressed in both cases.

Figure 5:
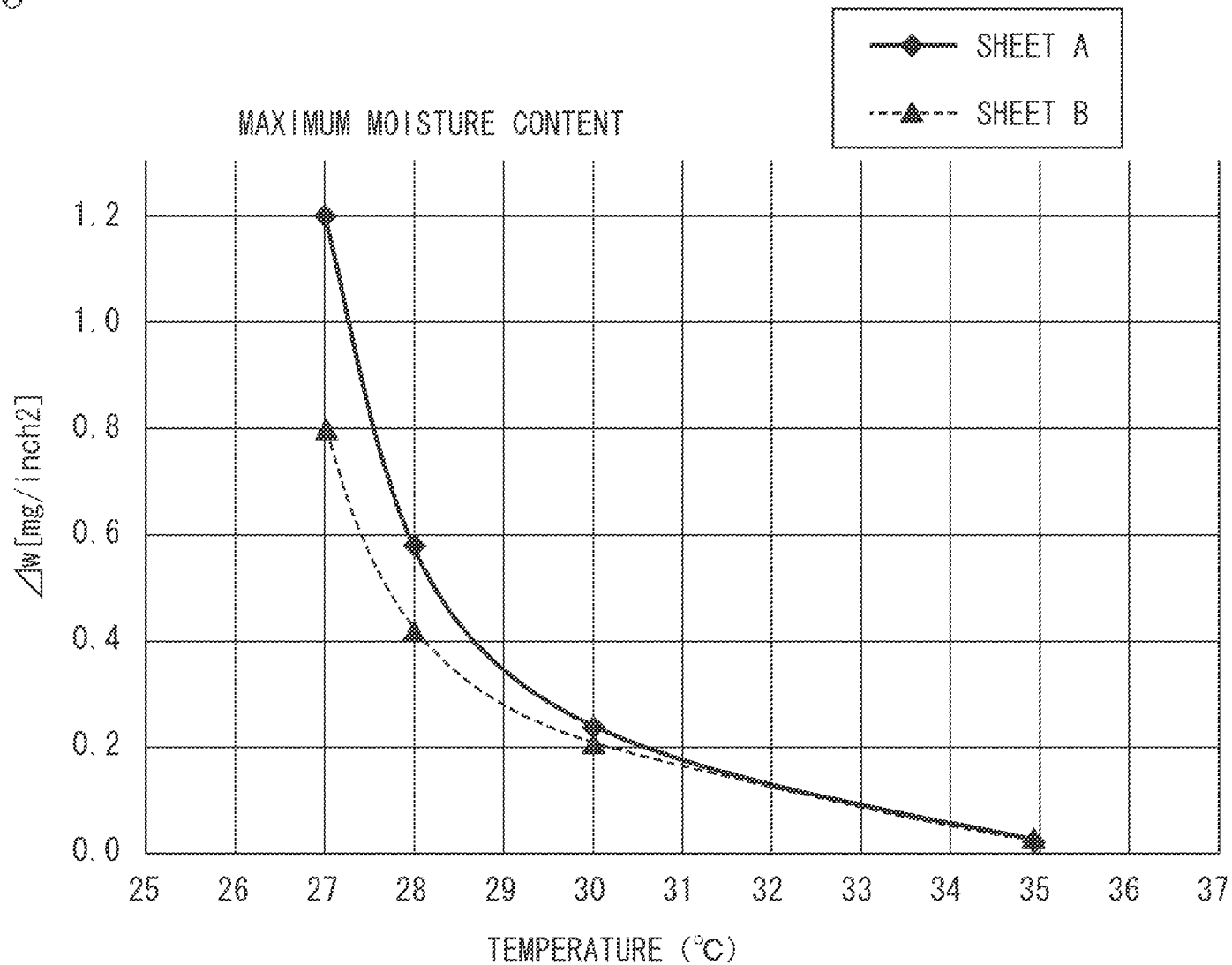
FIG. 5 is a graph illustrating moisture content versus sheet temperature.

FIG. 5 is a graph plotting an actually measured relationship between sheet temperature and maximum moisture content for two types of paper sheet (sheet A and sheet B). The horizontal axis represents temperature (units: ° C.) and the vertical axis represents maximum moisture content Aw (units: mg/inch$^2$). As illustrated in FIG. 5, the lower the sheet temperature, the greater the maximum moisture content of the sheet.

The temperature of a sheet immediately after passing the decurling unit 2 is denoted as a first temperature (about 35° C.). As illustrated in the graph of FIG. 5, at this temperature the sheet has hardly absorbed any moisture. Next, the sheet is cooled to a second temperature (about 30° C.) by active cooling by the cooling unit 30. The second temperature is a temperature (about 33° C.) less than or equal to the temperature in the nozzle exposed space where the print head 14 is exposed by the printing unit 4. As illustrated in the graph of FIG. 5, at the second temperature the sheet has a greater moisture absorbing capacity than at the first temperature. Therefore, the humidified gas supplied from the first supply port 21 is effectively absorbed by the sheet, so that when this sheet passes through the nozzle exposed space below the print head 14, the amount of moisture absorbed by the sheet from this space is low. Consequently, the ink drying of the nozzles is effectively suppressed.

If there is no cooling unit 30 for performing active cooling, the sheet proceeds, with natural cooling, to the first supply port 21 region without the temperature of the sheet sufficiently decreasing (e.g., remains at about 32° C.). The amount of moisture absorbed by the hot sheet from the humidified gas at the first supply port 21 is small. If the sheet is fed to the printing unit with little absorbed moisture, the hygroscopicity of the sheet increases along with the decrease in the temperature of the sheet while it is fed to the printing unit, even while it is fed through the printing unit. Consequently, the sheet passing through the nozzle exposed space of the print head 14 absorbs moisture in that space, which causes the humidity in the space to decrease, so that the risk of printing defects occurring due to the nozzles drying increases.

Further, if there is no cooling unit 30 for performing active cooling, the sheet conveyed through the nozzle exposed space will have a higher temperature than that space, so that condensation tends to form on the nozzle faces in the print head. Condensation forms because when a hot sheet enters the nozzle exposed space, the temperature of that space increases, causing the amount of saturated vapor in the nozzle exposed space to increase, so that the dew point increases. Consequently, condensation tends to form on peripheral parts, such as the nozzle faces, which have a comparatively low temperature. If condensation forms on the nozzle faces, ink discharge problems can occur resulting in printing defects, and the condensed liquid can fall on the sheet to soil the sheet.

According to the present exemplary embodiment, a humidification effect is increased by, before humidification of the sheet, actively cooling a sheet that was heated before printing. Consequently, printing defects caused by drying of the print head can be suppressed, and condensation on the nozzle faces of the print head can also be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-232041 filed Oct. 21, 2011, which is hereby incorporated by reference herein in its entirety.

What is claimed is:

1. A printing apparatus comprising:

a cooling unit configured to actively cool a sheet;

a humidification unit configured to increase a moisture content of the sheet by supplying a humidified gas onto the sheet that has passed through the cooling unit; and an inkjet print head configured to perform printing on the sheet having a moisture content increased by the humidification unit.

2. The printing apparatus according to claim 1, further comprising a correction unit configured to correct sheet skew by forming a loop-shaped slack section on the conveyed sheet, wherein the cooling unit is configured to actively cool the loop-shaped slack section by blowing air.

3. The printing apparatus according to claim 2, wherein the cooling unit is configured to actively cool the loop-shaped slack section by blowing air from at least a direction that makes the loop bulge out.

4. The printing apparatus according to claim 2, wherein the cooling unit is configured to actively cool the loop-shaped slack section by blowing air from front and back surfaces of the sheet.

5. The printing apparatus according to claim 1, wherein the humidification unit is configured to supply the humidified gas onto the sheet before a space where nozzles in the inkjet print head are exposed.

6. The printing apparatus according to claim 5, wherein the humidification unit is configured to supply the humidified gas into a space where nozzles in the inkjet print head are exposed.

7. The printing apparatus according to claim 6, wherein the cooling unit is configured to actively cool the sheet so that a sheet temperature is less than or equal to a temperature in the space.

8. The printing apparatus according to claim 1, further comprising a decurling unit configured to decrease curl while applying heat to the sheet, wherein the sheet heated by the decurling unit is conveyed toward the cooling unit.

9. The printing apparatus according to claim 1, further comprising a drying unit configured to dry a printed sheet by applying heat, wherein in two-sided printing a sheet printed on a first surface and heated by passing through the drying unit is conveyed toward the cooling unit for printing on a second surface.

10. The printing apparatus according to claim 9, wherein a part of the heat generated by the drying unit is introduced into the humidification unit for generation of the humidified gas.

11. A method for printing comprising:

actively cooling a sheet;

increasing a moisture content of the sheet by supplying a humidified gas onto the sheet that has been actively cooled; and performing printing, with an inkjet print head, on the sheet having an increased moisture content.

* * * * *